US006937738B2

(12) United States Patent
Armstrong et al.

(10) Patent No.: US 6,937,738 B2
(45) Date of Patent: Aug. 30, 2005

(54) DIGITAL HEARING AID SYSTEM

(75) Inventors: Stephen W. Armstrong, Burlington (CA); Frederick E. Sykes, Burlington (CA); David R. Brown, Burlington (CA); James G. Ryan, Glouster (CA)

(73) Assignee: Gennum Corporation (CA)

( * ) Notice: Subject to any disclaimer, the term of this patent is extended or adjusted under 35 U.S.C. 154(b) by 581 days.

(21) Appl. No.: 10/121,221

(22) Filed: Apr. 12, 2002

(65) Prior Publication Data

US 2003/0012391 A1 Jan. 16, 2003

Related U.S. Application Data

(60) Provisional application No. 60/283,310, filed on Apr. 12, 2001.

(51) Int. Cl.[7] ..... H04R 25/00

(52) U.S. Cl. ..... 381/312; 381/92; 381/313

(58) Field of Search ..... 381/83, 92, 94.1, 381/93, 312, 313, 314, 317, 318, 320, 321

(56) References Cited

U.S. PATENT DOCUMENTS

| | | | |
|---|---|---|---|
| 4,119,814 | A | 10/1978 | Harless |
| 4,142,072 | A | 2/1979 | Berland |
| 4,187,413 | A | 2/1980 | Moser |

(Continued)

FOREIGN PATENT DOCUMENTS

| | | |
|---|---|---|
| DE | 19624092 | 11/1997 |
| DE | 19822021 | 12/1999 |
| DE | 19935013 | 11/2000 |
| EP | 89101149.6 | 8/1989 |
| EP | 91480009.9 | 7/1992 |
| EP | 93203072.9 | 5/1994 |
| JP | 2-192300 | 7/1990 |
| WO | WO 83/02212 | 6/1983 |
| WO | WO 89/04583 | 5/1989 |
| WO | WO 95/08248 | 3/1995 |
| WO | WO 97/14266 | 4/1997 |

OTHER PUBLICATIONS

Lunner, Thomas and Hellgren, Johan, "A Digital Filterbank Hearing Aid–Design, Implementation and Evaluation", Department of Electronic Engineering and Department of Otorhinolaryngology, University of Linkoping, Sweden, pp. 3661–3664.

Lee, Jo–Hong and Kang, Wen–Juh, "Filter Design for Polyphase Filter Banks with Arbitrary Number of Subband Channels", Department of Electrical Engineering, National Taiwan University, Taipei, Taiwan, Republic of China, pp. 1720–1723.

*Primary Examiner*—Huyen D. Le
(74) *Attorney, Agent, or Firm*—Jones Day

(57) ABSTRACT

A digital hearing aid is provided that includes front and rear microphones, a sound processor, and a speaker. Embodiments of the digital hearing aid include an occlusion subsystem, and a directional processor and headroom expander. The front microphone receives a front microphone acoustical signal and generates a front microphone analog signal. The rear microphone receives a rear microphone acoustical signal and generates a rear microphone analog signal. The front and rear microphone analog signals are converted into the digital domain, and at least the front microphone signal is coupled to the sound processor. The sound processor selectively modifies the signal characteristics and generates a processed signal. The processed signal is coupled to the speaker which converts the signal to an acoustical hearing aid output signal that is directed into the ear canal of the digital hearing aid user. The occlusion sub-system compensates for the amplification of the digital hearing aid user's own voice within the ear canal. The directional processor and headroom expander optimizes the gain applied to the acoustical signals received by the digital hearing aid and combine the amplified signals into a directionally-sensitive response.

15 Claims, 6 Drawing Sheets

U.S. PATENT DOCUMENTS

| | | | |
|---|---|---|---|
| 4,289,935 | A | 9/1981 | Zollner et al. |
| 4,395,588 | A | 7/1983 | Franssen, deceased et al. |
| 4,403,118 | A | 9/1983 | Zollner et al. |
| 4,455,675 | A | 6/1984 | Bose et al. |
| 4,471,171 | A | 9/1984 | Köpke et al. |
| 4,494,074 | A | 1/1985 | Bose |
| 4,508,940 | A | 4/1985 | Steeger |
| 4,592,087 | A | 5/1986 | Killion |
| 4,644,581 | A | 2/1987 | Sapiejewski |
| 4,689,818 | A | 8/1987 | Ammitzboll |
| 4,689,820 | A | 8/1987 | Köpke et al. |
| 4,696,032 | A | 9/1987 | Levy |
| 4,712,244 | A | 12/1987 | Zwicker et al. |
| 4,750,207 | A | 6/1988 | Gebert et al. |
| 4,833,719 | A | 5/1989 | Carme et al. |
| 4,852,175 | A | 7/1989 | Kates |
| 4,868,880 | A | 9/1989 | Bennett, Jr. |
| 4,882,762 | A | 11/1989 | Waldhauer |
| 4,947,432 | A | 8/1990 | T pholm |
| 4,947,433 | A | 8/1990 | Gebert |
| 4,953,216 | A | 8/1990 | Beer |
| 4,953,217 | A | 8/1990 | Twiney et al. |
| 4,985,925 | A | 1/1991 | Langberg et al. |
| 4,989,251 | A | 1/1991 | Mangold |
| 4,995,085 | A | 2/1991 | Kern et al. |
| 5,029,217 | A | 7/1991 | Chabries et al. |
| 5,033,082 | A | 7/1991 | Eriksson et al. |
| 5,033,090 | A | 7/1991 | Weinrich |
| 5,046,102 | A | 9/1991 | Zwicker et al. |
| 5,111,419 | A | 5/1992 | Morley, Jr. et al. |
| 5,144,674 | A | 9/1992 | Meyer et al. |
| 5,189,704 | A | 2/1993 | Krauss |
| 5,201,006 | A | 4/1993 | Weinrich |
| 5,202,927 | A | 4/1993 | T pholm |
| 5,210,803 | A | 5/1993 | Martin et al. |
| 5,241,310 | A | 8/1993 | Tiemann |
| 5,247,581 | A | 9/1993 | Gurcan |
| 5,251,263 | A | 10/1993 | Andrea et al. |
| 5,267,321 | A | 11/1993 | Langberg |
| 5,276,739 | A | 1/1994 | Krokstad et al. |
| 5,278,912 | A | 1/1994 | Waldhauer |
| 5,347,587 | A | 9/1994 | Takahashi et al. |
| 5,376,892 | A | 12/1994 | Gata |
| 5,389,829 | A | 2/1995 | Milazzo |
| 5,448,644 | A | 9/1995 | Pfannemueller et al. |
| 5,452,361 | A | 9/1995 | Jones |
| 5,479,522 | A | 12/1995 | Lindemann et al. |
| 5,500,902 | A | 3/1996 | Stockham, Jr. et al. |
| 5,515,443 | A | 5/1996 | Meyer |
| 5,524,150 | A | 6/1996 | Sauer |
| 5,600,729 | A | 2/1997 | Darlington et al. |
| 5,604,812 | A | 2/1997 | Meyer |
| 5,608,803 | A | 3/1997 | Magotra et al. |
| 5,613,008 | A | 3/1997 | Martin |
| 5,649,019 | A | 7/1997 | Thomasson |
| 5,661,814 | A | 8/1997 | Kälin et al. |
| 5,687,241 | A | 11/1997 | Ludvigsen |
| 5,706,351 | A | 1/1998 | Weinfurtner |
| 5,710,820 | A | 1/1998 | Martin et al. |
| 5,717,770 | A | 2/1998 | Weinfurtner |
| 5,719,528 | A | 2/1998 | Rasmussen et al. |
| 5,724,433 | A | 3/1998 | Engebretson et al. |
| 5,740,257 | A | 4/1998 | Marcus |
| 5,740,258 | A | 4/1998 | Goodwin-Johansson |
| 5,754,661 | A | 5/1998 | Weinfurtner |
| 5,796,848 | A | 8/1998 | Martin |
| 5,809,151 | A | 9/1998 | Husung |
| 5,815,102 | A | 9/1998 | Melanson |
| 5,838,801 | A | 11/1998 | Ishige et al. |
| 5,838,806 | A | 11/1998 | Sigwanz et al. |
| 5,848,171 | A | 12/1998 | Stockham, Jr. et al. |
| 5,862,238 | A | 1/1999 | Agnew et al. |
| 5,878,146 | A | 3/1999 | Anderson |
| 5,896,101 | A | 4/1999 | Melanson |
| 5,912,977 | A | 6/1999 | Gottschalk-Schoenig |
| 6,005,954 | A | 12/1999 | Weinfurtner |
| 6,044,162 | A | 3/2000 | Mead et al. |
| 6,044,163 | A | 3/2000 | Weinfurtner |
| 6,049,617 | A | 4/2000 | Sigwanz et al. |
| 6,049,618 | A | 4/2000 | Saltkov |
| 6,108,431 | A | 8/2000 | Bachler |
| 6,118,878 | A | 9/2000 | Jones |
| 6,175,635 | B1 | 1/2001 | Meyer et al. |
| 6,198,830 | B1 | 3/2001 | Holube et al. |
| 6,236,731 | B1 | 5/2001 | Brennan et al. |
| 6,240,192 | B1 | 5/2001 | Brennan et al. |
| 6,240,195 | B1 | 5/2001 | Bindner et al. |
| 6,272,229 | B1 | 8/2001 | Baekgaard |
| 6,278,786 | B1 | 8/2001 | McIntosh |
| 6,445,799 | B1 | 9/2002 | Taenzer et al. |
| 2002/0076073 | A1 | 6/2002 | Taenzer et al. |
| 2002/0150269 | A1 | 10/2002 | Ludvigsen |
| 2002/0164041 | A1 | 11/2002 | Zurek |

DIGITAL HEARING AID SYSTEM

CROSS-REFERENCE TO RELATED APPLICATION

This application claims priority from and is related to the following prior application: Digital Hearing Aid System, U.S. Provisional Application No. 60/283,310, filed Apr. 12, 2001. This prior application, including the entire written description and drawing figures, is hereby incorporated into the present application by reference.

BACKGROUND

1. Field of the Invention

This invention generally relates to hearing aids. More specifically, the invention provides an advanced digital hearing aid system.

2. Description of the Related Art

Digital hearing aids are known in this field. These hearing aids, however, suffer from several disadvantages that are overcome by the present invention. For instance, one embodiment of the present invention includes an occlusion sub-system which compensates for the amplification of the digital hearing aid user's own voice within the ear canal. Another embodiment of the present invention includes a directional processor and a headroom expander which optimize the gain applied to the acoustical signals received by the digital hearing aid and combine the amplified signals into a directionally-sensitive response. In addition, the present invention includes other advantages over known digital hearing aids, as described below.

SUMMARY

A digital hearing aid is provided that includes front and rear microphones, a sound processor, and a speaker. Embodiments of the digital hearing aid include an occlusion subsystem, and a directional processor and headroom expander. The front microphone receives a front microphone acoustical signal and generates a front microphone analog signal. The rear microphone receives a rear microphone acoustical signal and generates a rear microphone analog signal. The front and rear microphone analog signals are converted into the digital domain, and at least the front microphone signal is coupled to the sound processor. The sound processor selectively modifies the signal characteristics and generates a processed signal. The processed signal is coupled to the speaker which converts the signal to an acoustical hearing aid output signal that is directed into the ear canal of the digital hearing aid user. The occlusion sub-system compensates for the amplification of the digital hearing aid user's own voice within the ear canal. The directional processor and headroom expander optimizes the gain applied to the acoustical signals received by the digital hearing aid and combine the amplified signals into a directionally-sensitive response.

DETAILED DESCRIPTION OF THE DRAWINGS

Figure 1A:
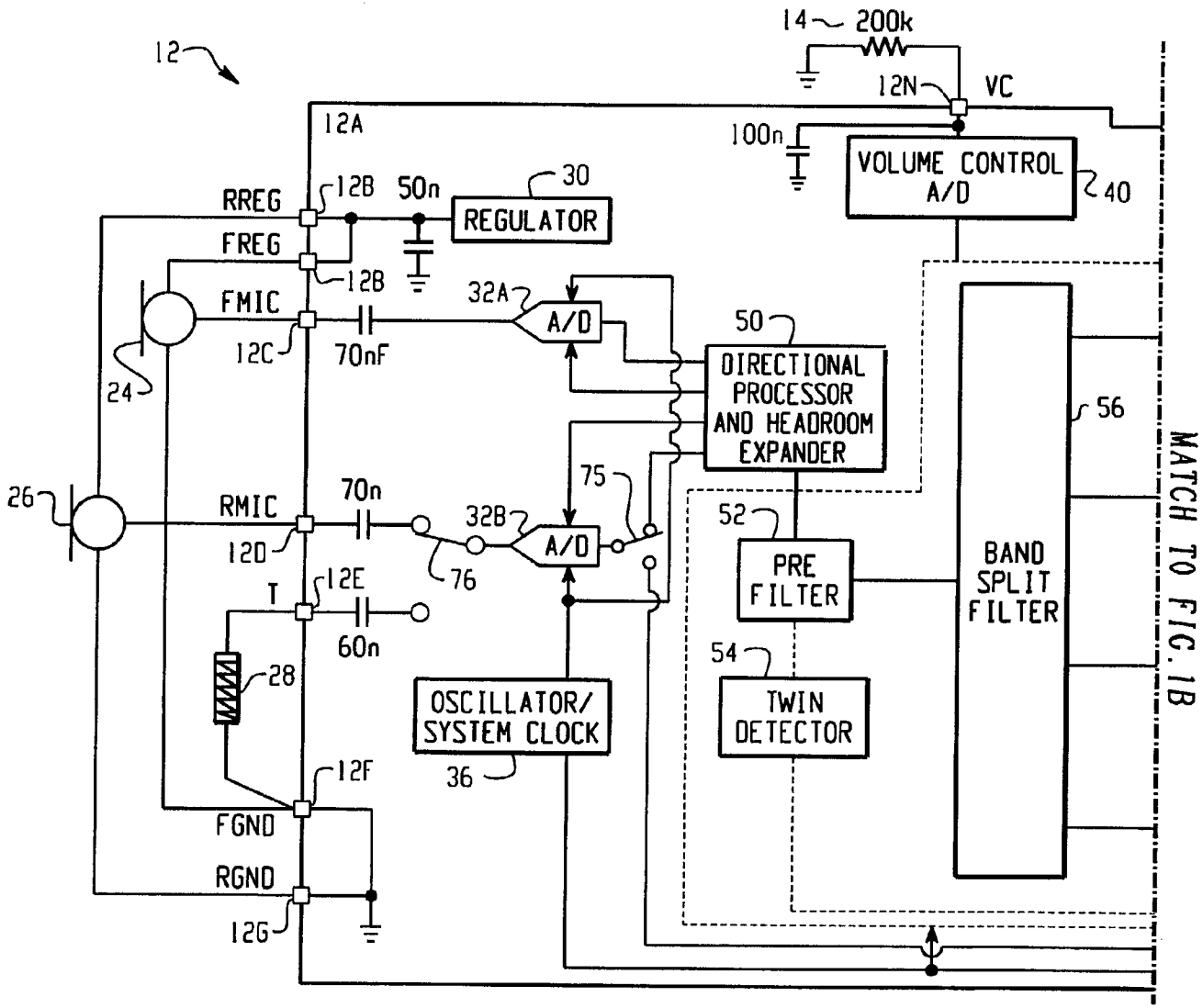
FIG. 1 is a block diagram of an exemplary digital hearing aid system according to the present invention.
Figure 1B:
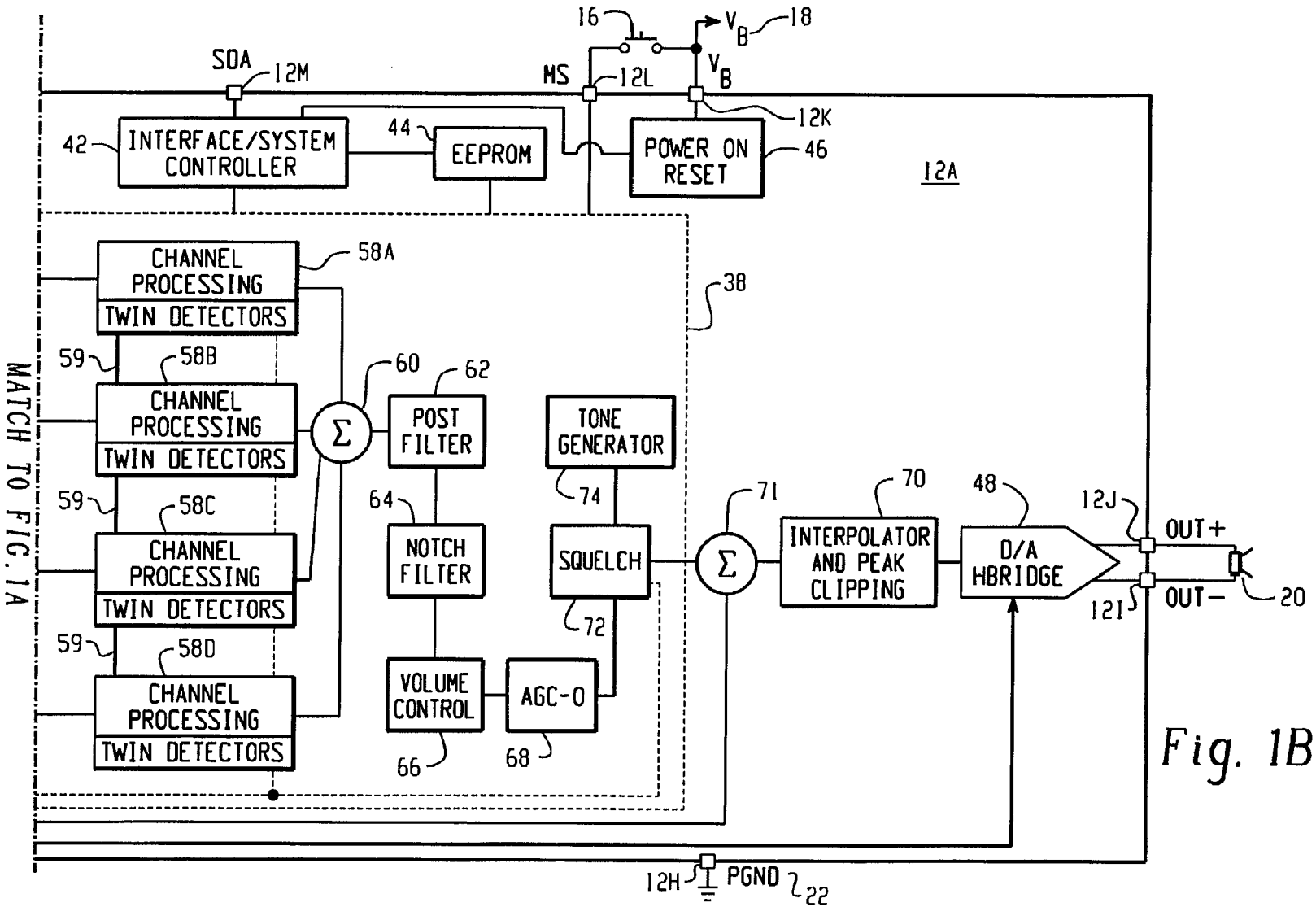

Turning now to the drawing figure, FIG. 1 is a block diagram of an exemplary digital hearing aid system 12. The digital hearing aid system 12 includes several external components 14, 16, 18, 20, 22, 24, 26, 28, and, preferably, a single integrated circuit (IC) 12A. The external components include a pair of microphones 24, 26, a tele-coil 28, a volume control potentiometer 24, a memory-select toggle switch 16, battery terminals 18, 22, and a speaker 20.

Sound is received by the pair of microphones 24, 26, and converted into electrical signals that are coupled to the FMIC 12C and RMIC 12D inputs to the IC 12A. FMIC refers to "front microphone," and RMIC refers to "rear microphone." The microphones 24, 26 are biased between a regulated voltage output from the RREG and FREG pins 12B, and the ground nodes FGND 12F, RGND 12G. The regulated voltage output on FREG and RREG is generated internally to the IC 12A by regulator 30.

The tele-coil 28 is a device used in a hearing aid that magnetically couples to a telephone handset and produces an input current that is proportional to the telephone signal. This input current from the tele-coil 28 is coupled into the rear microphone A/D converter 32B on the IC 12A when the switch 76 is connected to the "T" input pin 12E, indicating that the user of the hearing aid is talking on a telephone. The tele-coil 28 is used to prevent acoustic feedback into the system when talking on the telephone.

The volume control potentiometer 14 is coupled to the volume control input 12N of the IC. This variable resistor is used to set the volume sensitivity of the digital hearing aid.

The memory-select toggle switch 16 is coupled between the positive voltage supply VB 18 to the IC 12A and the memory-select input pin 12L. This switch 16 is used to toggle the digital hearing aid system 12 between a series of setup configurations. For example, the device may have been previously programmed for a variety of environmental settings, such as quiet listening, listening to music, a noisy setting, etc. For each of these settings, the system parameters of the IC 12A may have been optimally configured for the particular user. By repeatedly pressing the toggle switch 16, the user may then toggle through the various configurations stored in the read-only memory 44 of the IC 12A.

The battery terminals 12K, 12H of the IC 12A are preferably coupled to a single 1.3 volt zinc-air battery. This battery provides the primary power source for the digital hearing aid system.

The last external component is the speaker 20. This element is coupled to the differential outputs at pins 12J, 12I of the IC 12A, and converts the processed digital input signals from the two microphones 24, 26 into an audible signal for the user of the digital hearing aid system 12.

There are many circuit blocks within the IC 12A. Primary sound processing within the system is carried out by the sound processor 38. A pair of A/D converters 32A, 32B are coupled between the front and rear microphones 24, 26, and the sound processor 38, and convert the analog input signals into the digital domain for digital processing by the sound processor 38. A single D/A converter 48 converts the processed digital signals back into the analog domain for output by the speaker 20. Other system elements include a regulator 30, a volume control A/D 40, an interface/system controller 42, an EEPROM memory 44, a power-on reset circuit 46, and a oscillator/system clock 36.

The sound processor 38 preferably includes a directional processor and headroom expander 50, a pre-filter 52, a wide-band twin detector 54, a band-split filter 56, a plurality of narrow-band channel processing and twin detectors 58A–58D, a summer 60, a post filter 62, a notch filter 64, a volume control circuit 66, an automatic gain control output circuit 68, a peak clipping circuit 70, a squelch circuit 72, and a tone generator 74.

Operationally, the sound processor 38 processes digital sound as follows. Sound signals input to the front and rear microphones 24, 26 are coupled to the front and rear A/D converters 32A, 32B, which are preferably Sigma-Delta modulators followed by decimation filters that convert the analog sound inputs from the two microphones into a digital equivalent. Note that when a user of the digital hearing aid system is talking on the telephone, the rear A/D converter 32B is coupled to the tele-coil input "T" 12E via switch 76. Both of the front and rear A/D converters 32A, 32B are clocked with the output clock signal from the oscillator/system clock 36 (discussed in more detail below). This same output clock signal is also coupled to the sound processor 38 and the D/A converter 48.

The front and rear digital sound signals from the two A/D converters 32A, 32B are coupled to the directional processor and headroom expander 50 of the sound processor 38. The rear A/D converter 32B is coupled to the processor 50 through switch 75. In a first position, the switch 75 couples the digital output of the rear A/D converter 32 B to the processor 50, and in a second position, the switch 75 couples the digital output of the rear A/D converter 32B to summation block 71 for the purpose of compensating for occlusion.

Occlusion is the amplification of the users own voice within the ear canal. The rear microphone can be moved inside the ear canal to receive this unwanted signal created by the occlusion effect. The occlusion effect is usually reduced in these types of systems by putting a mechanical vent in the hearing aid. This vent, however, can cause an oscillation problem as the speaker signal feeds back to the microphone(s) through the vent aperture. Another problem associated with traditional venting is a reduced low frequency response (leading to reduced sound quality). Yet another limitation occurs when the direct coupling of ambient sounds results in poor directional performance, particularly in the low frequencies. The system shown in FIG. 1 solves these problems by canceling the unwanted signal received by the rear microphone 26 by feeding back the rear signal from the A/D converter 32B to summation circuit 71. The summation circuit 71 then subtracts the unwanted signal from the processed composite signal to thereby compensate for the occlusion effect. An more-detailed occlusion subsystem is described below with reference to FIGS. 2 and 3.

The directional processor and headroom expander 50 includes a combination of filtering and delay elements that, when applied to the two digital input signals, forms a single, directionally-sensitive response. This directionally-sensitive response is generated such that the gain of the directional processor 50 will be a maximum value for sounds coming from the front microphone 24 and will be a minimum value for sounds coming from the rear microphone 26.

The headroom expander portion of the processor 50 significantly extends the dynamic range of the A/D conversion, which is very important for high fidelity audio signal processing. It does this by dynamically adjusting the A/D converters 32A/32B operating points. The headroom expander 50 adjusts the gain before and after the A/D conversion so that the total gain remains unchanged, but the intrinsic dynamic range of the A/D converter block 32A/32B is optimized to the level of the signal being processed. The headroom expander portion of the processor 50 is described below in more detail with reference to FIGS. 4 and 5.

The output from the directional processor and headroom expander 50 is coupled to a pre-filter 52, which is a general-purpose filter for pre-conditioning the sound signal prior to any further signal processing steps. This "pre-conditioning" can take many forms, and, in combination with corresponding "post-conditioning" in the post filter 62, can be used to generate special effects that may be suited to only a particular class of users. For example, the pre-filter 52 could be configured to mimic the transfer function of the user's middle ear, effectively putting the sound signal into the "cochlear domain." Signal processing algorithms to correct a hearing impairment based on, for example, inner hair cell loss and outer hair cell loss, could be applied by the sound processor 38. Subsequently, the post-filter 62 could be configured with the inverse response of the pre-filter 52 in order to convert the sound signal back into the "acoustic domain" from the "cochlear domain." Of course, other pre-conditioning/post-conditioning configurations and corresponding signal processing algorithms could be utilized.

The pre-conditioned digital sound signal is then coupled to the band-split filter 56, which preferably includes a bank of filters with variable corner frequencies and pass-band gains. These filters are used to split the single input signal into four distinct frequency bands. The four output signals from the band-split filter 56 are preferably in-phase so that when they are summed together in block 60, after channel processing, nulls or peaks in the composite signal (from the summer) are minimized.

Channel processing of the four distinct frequency bands from the band-split filter 56 is accomplished by a plurality of channel processing/twin detector blocks 58A–58D. Although four blocks are shown in FIG. 1, it should be clear that more than four (or less than four) frequency bands could be generated in the band-split filter 56, and thus more or less than four channel processing/twin detector blocks 58 may be utilized with the system.

Each of the channel processing/twin detectors 58A–58D provide an automatic gain control ("AGC") function that provides compression and gain on the particular frequency band (channel) being processed. Compression of the channel signals permits quieter sounds to be amplified at a higher gain than louder sounds, for which the gain is compressed. In this manner, the user of the system can hear the full range of sounds since the circuits 58A–58D compress the full range of normal hearing into the reduced dynamic range of the individual user as a function of the individual user's hearing loss within the particular frequency band of the channel.

The channel processing blocks 58A–58D can be configured to employ a twin detector average detection scheme while compressing the input signals. This twin detection scheme includes both slow and fast attack/release tracking modules that allow for fast response to transients (in the fast tracking module), while preventing annoying pumping of the input signal (in the slow tracking module) that only a fast time constant would produce. The outputs of the fast and slow tracking modules are compared, and the compression slope is then adjusted accordingly. The compression ratio, channel gain, lower and upper thresholds (return to linear point), and the fast and slow time constants (of the fast and slow tracking modules) can be independently programmed and saved in memory 44 for each of the plurality of channel processing blocks 58A–58D.

FIG. 1 also shows a communication bus 59, which may include one or more connections, for coupling the plurality of channel processing blocks 58A–58D. This inter-channel communication bus 59 can be used to communicate information between the plurality of channel processing blocks 58A–58D such that each channel (frequency band) can take into account the "energy" level (or some other measure) from the other channel processing blocks. Preferably, each channel processing block 58A–58D would take into account the "energy" level from the higher frequency channels. In addition, the "energy" level from the wide-band detector 54 may be used by each of the relatively narrow-band channel processing blocks 58A–58D when processing their individual input signals.

After channel processing is complete, the four channel signals are summed by summer 60 to form a composite signal. This composite signal is then coupled to the post-filter 62, which may apply a post-processing filter function as discussed above. Following post-processing, the composite signal is then applied to a notch-filter 64, that attenuates a narrow band of frequencies that is adjustable in the frequency range where hearing aids tend to oscillate. This notch filter 64 is used to reduce feedback and prevent unwanted "whistling" of the device. Preferably, the notch filter 64 may include a dynamic transfer function that changes the depth of the notch based upon the magnitude of the input signal.

Following the notch filter 64, the composite signal is then coupled to a volume control circuit 66. The volume control circuit 66 receives a digital value from the volume control A/D 40, which indicates the desired volume level set by the user via potentiometer 14, and uses this stored digital value to set the gain of an included amplifier circuit.

From the volume control circuit, the composite signal is then coupled to the AGC-output block 68. The AGC-output circuit 68 is a high compression ratio, low distortion limiter that is used to prevent pathological signals from causing large scale distorted output signals from the speaker 20 that could be painful and annoying to the user of the device. The composite signal is coupled from the AGC-output circuit 68 to a squelch circuit 72, that performs an expansion on low-level signals below an adjustable threshold. The squelch circuit 72 uses an output signal from the wide-band detector 54 for this purpose. The expansion of the low-level signals attenuates noise from the microphones and other circuits when the input S/N ratio is small, thus producing a lower noise signal during quiet situations. Also shown coupled to the squelch circuit 72 is a tone generator block 74, which is included for calibration and testing of the system.

The output of the squelch circuit 72 is coupled to one input of summer 71. The other input to the summer 71 is from the output of the rear A/D converter 32B, when the switch 75 is in the second position. These two signals are summed in summer 71, and passed along to the interpolator and peak clipping circuit 70. This circuit 70 also operates on pathological signals, but it operates almost instantaneously to large peak signals and is high distortion limiting. The interpolator shifts the signal up in frequency as part of the D/A process and then the signal is clipped so that the distortion products do not alias back into the baseband frequency range.

The output of the interpolator and peak clipping circuit 70 is coupled from the sound processor 38 to the D/A H-Bridge 48. This circuit 48 converts the digital representation of the input sound signals to a pulse density modulated representation with complimentary outputs. These outputs are coupled off-chip through outputs 12J, 12I to the speaker 20, which low-pass filters the outputs and produces an acoustic analog of the output signals. The D/A H-Bridge 48 includes an interpolator, a digital Delta-Sigma modulator, and an H-Bridge output stage. The D/A H-Bridge 48 is also coupled to and receives the clock signal from the oscillator/system clock 36 (described below).

The interface/system controller 42 is coupled between a serial data interface pin 12M on the IC 12, and the sound processor 38. This interface is used to communicate with an external controller for the purpose of setting the parameters of the system. These parameters can be stored on-chip in the EEPROM 44. If a "black-out" or "brown-out" condition occurs, then the power-on reset circuit 46 can be used to signal the interface/system controller 42 to configure the system into a known state. Such a condition can occur, for example, if the battery fails.

Figure 2:
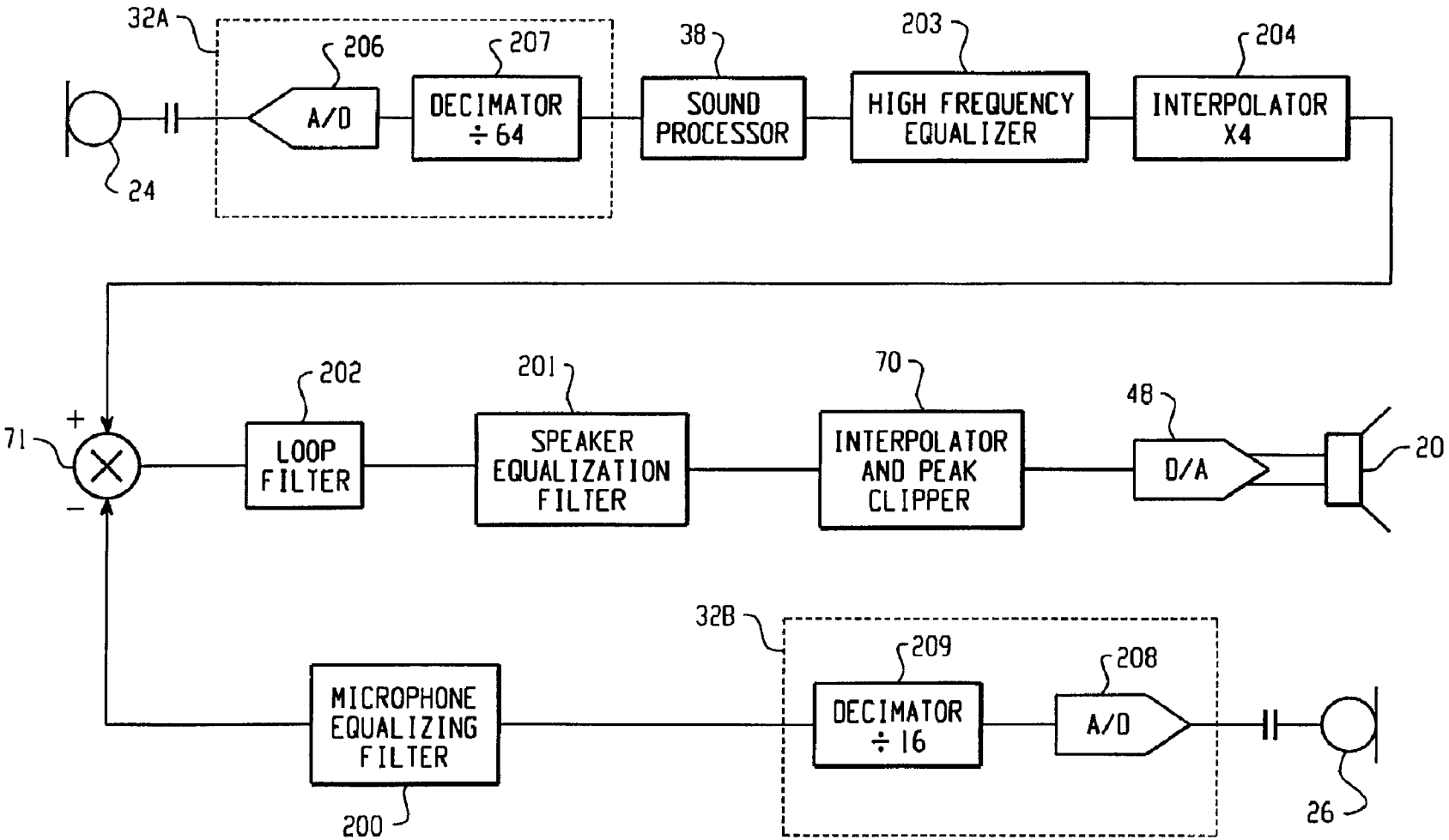
FIG. 2 is a block diagram of an occlusion sub-system for the digital hearing aid system shown in FIG. 1.

FIG. 2 is a block diagram of an occlusion sub-system for the digital hearing aid system 12 shown in FIG. 1. The occlusion sub-system includes a number of components described above with reference to FIG. 1, including the front and rear microphones 24, 26, the front and rear microphone A/D converters 32A, 32B, the directional processor and headroom expander 50, the sound processor 38, the summation circuit 71, the peak clipping circuit 70, the D/A converter 48, and the speaker 20. In addition, the occlusion sub-system further includes a high frequency equalizer 203, an interpolator 204, a microphone equalization filter 200, a loop filter 202, and a speaker equalization filter 201.

The occlusion sub-system includes two signal paths: (1) an intended signal received by the front microphone 24 and amplified for the hearing impaired user, and (2) an acoustical occlusion signal originating in the ear canal that is received by the rear microphone 26 and cancelled in a feedback loop by the occlusion sub-system. The intended signal received by the front microphone is converted from the analog to the digital domain with the front microphone A/D converter 32A. The front microphone A/D converter 32A includes an A/D conversion block 206 which converts the signal into the digital domain, and a decimator block 207 which down-samples the signal to achieve a lower-speed, higher-resolution digital signal. The decimator block 207 may, for example, down-sample the signal by a factor of sixty-four (64). The output from the front microphone A/D converter 32A is then coupled to the sound processor 38 which amplifies and conditions the signal as described above with reference to FIG. 1.

The output from the sound processor 38 is filtered by the high frequency equalizer block 203. The characteristics of the high frequency equalizer block 203 are described below with reference to FIG. 3. The output from the high frequency equalizer block 203 is up-sampled by the interpolator 204, and coupled as a positive input to the summation circuit 71. The interpolator 204 may, for example, up-sample the signal by a factor of four (4). The interpolation block 204 is included to transform the low-rate signal processing output from the sound processor 38 and high frequency equalizer 203 to a medium-rate signal that may be used for the occlusion cancellation process.

The acoustical occlusion signal received by the rear microphone 26 is similarly converted from the analog to the digital domain with the rear microphone A/D converter 32B. The rear microphone A/D converter 32B includes an A/D conversion block 208 which converts the occlusion signal to the digital domain and a decimator block 209 which down-samples the signal. The decimator block 209 may, for example, down-sample the occlusion signal by a factor of sixteen (16), resulting in lower-speed, higher-resolution signal characteristics that are desirable for both low power and low noise operation.

The output from the rear microphone A/D converter 32A is coupled to the microphone equalizing circuit 200 which mirrors the magnitude response of the rear microphone 26 and A/D combination in order to yield an overall flat microphone effect that is desirable for optimal performance. The output of the microphone equalizing circuit 200 is then coupled as a negative input to the summation circuit 71.

The output from the summation circuit 71 is coupled to the loop filter 202 which filters the signal to the optimal magnitude and phase characteristics necessary for stable closed-loop operation. The filter characteristics for the loop filter 202 necessary to obtain a stable closed loop operation are commonly understood by those skilled in the art of control system theory. Ideally, a gain greater than unity gain is desirable to achieve the beneficial results of negative feedback to reduce the occlusion effect. The loop gain should, however, be less than unity when the overall phase response passes through 180 degrees of shift. Otherwise, the overall feedback may become positive, resulting in system instability.

The output from the loop filter 202 is coupled to the speaker equalization filter 201 which flattens the overall transfer function of the Interpolator 70, D/A 48 and speaker 20 combination. It should be understood, however, that the loop filter 202 and speaker equalization filter 201 could be combined into one filter block, but are separated in this description to improve clarity. The output of the speaker equalizer filter 201 is then coupled to the speaker 20 through the interpolator/peak clipper 70 and D/A converter 48, as described above with reference to FIG. 1.

Operationally, the filtered occlusion signal coupled as a negative input to the summation circuit 71 produces an overall negative feedback loop when coupled by blocks 202, 201, 70 and 48 to the speaker 20. Ideally, the frequency at which the overall phase response of the occlusion sub-system approaches 180 degrees (zero phase margin) is as high as practically possible. Time delays resulting from inherent sample-based mathematical operations used in digital signal processing may produce excess phase delay. In addition, the common use of highly oversampled low resolution sigma delta analog to digital (and digital to analog) converters and their associated high-order decimators and interpolators may produce significant group delays leading to less then optimal performance from a system as described herein. Thus, the illustrated occlusion sub-system provides a mixed sample rate solution whereby the low time delay signal processing is performed at a higher sampling rate than the hearing loss compensation algorithms resulting in greatly reduced delays since the decimation and interpolator designs need not be as high order.

Figure 3:
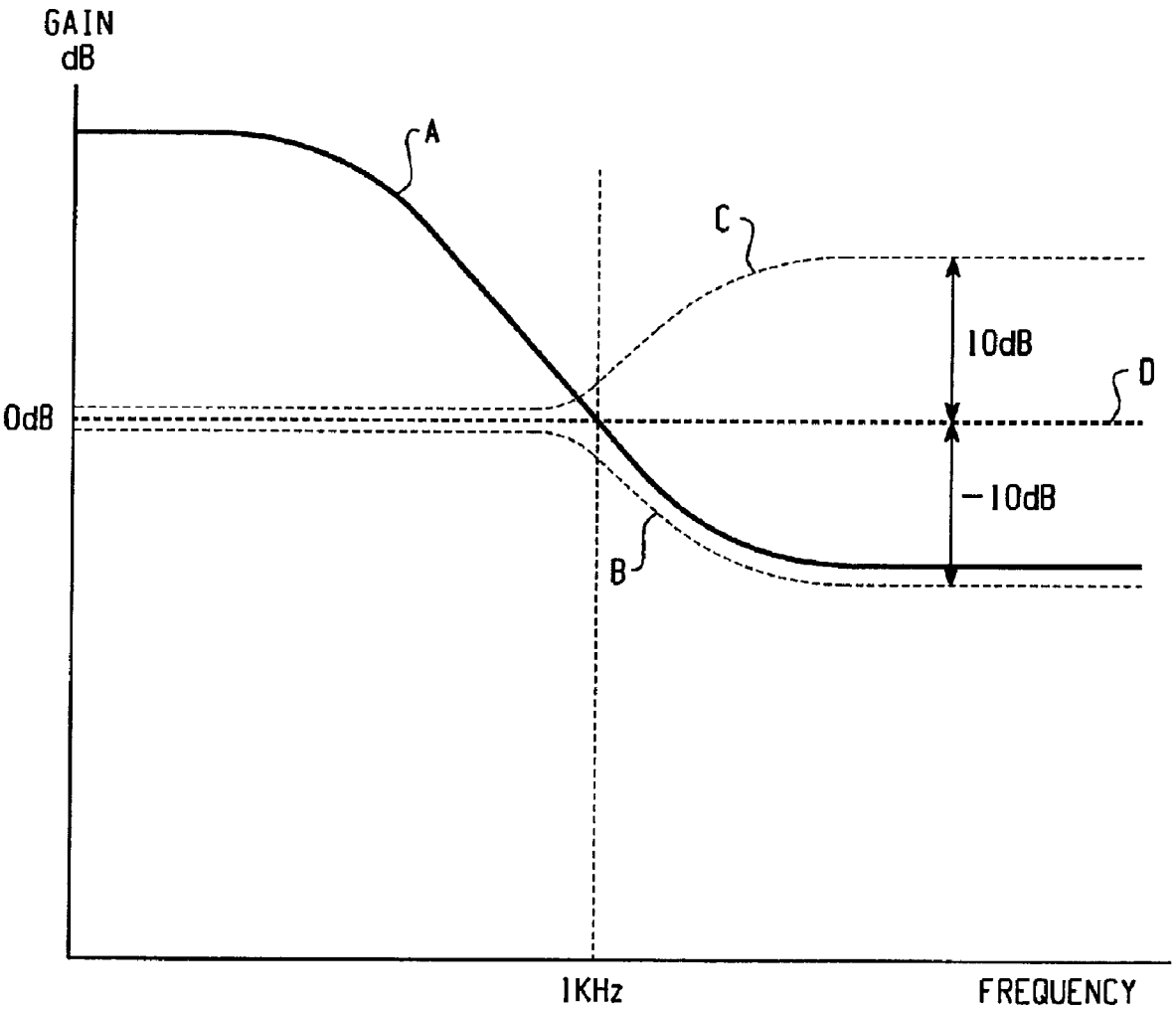
FIG. 3 is a graph showing an exemplary frequency response for the frequency equalizer block shown in FIG. 2.

FIG. 3 is a graph 300 showing an exemplary frequency response C for the frequency equalizer block 203 shown in FIG. 2. The frequency response for the frequency equalizer block 203 is illustrated as a dotted line labeled "C" on the graph 300. The graph 300 assumes ideal speaker and microphone equalization blocks 201, 200, such that the speaker and microphone transfer functions can be assumed to be flat (an ideal characteristic). Curve A illustrated on the graph 300 is a desired frequency response for the loop filter 202 in which the loop filter 202 exhibits greater than unity gain (or 0 dB) at low frequencies, indicating negative feedback and the resultant reduction in the occlusion energy present in the ear canal. As frequency increases, the open loop gain A reduces, crossing over the unity gain point at a frequency low enough to ensure stability while not unduly reducing the bandwidth over which this system operates (1 KHz for example). As a consequence of the frequency response A of the loop filter 202, the closed loop frequency response B should be nominally 0 dB up to a frequency roughly equal to the unity gain frequency of the open loop gain A, and then follow the shape of the open loop response A for higher frequencies.

In one alternative embodiment, also illustrated on FIG. 3, an overall flat frequency response D may be achieved by implementing the filter shape shown as curve C with the high frequency equalizer block 203. This embodiment results in about 10 dB of boost for frequencies above the transition frequency (1 KHz in this example).

Figure 4:
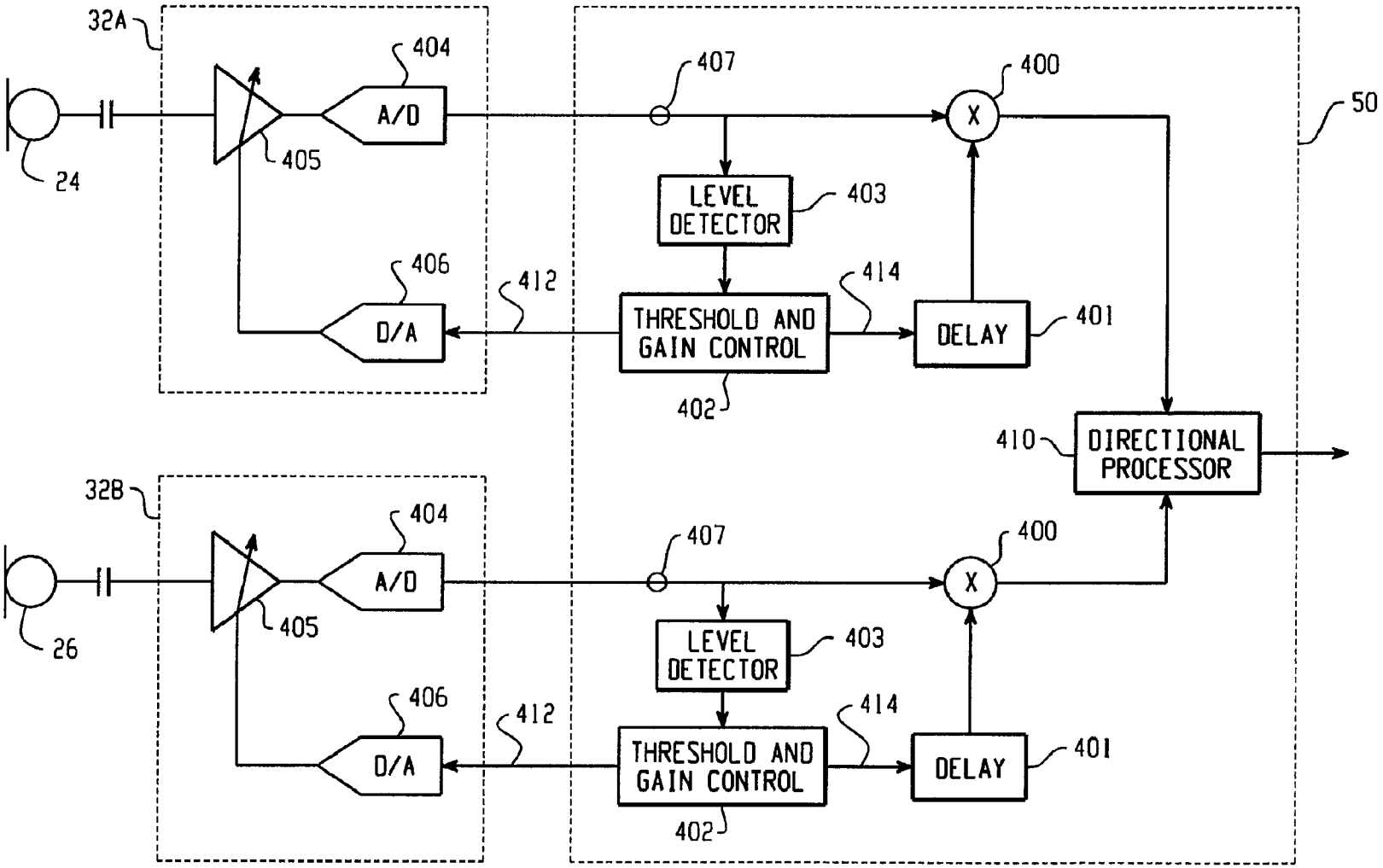
FIG. 4 is a more detailed block diagram of the headroom expander and analog-to-digital converters shown in FIG. 1.

FIG. 4 is a more detailed block diagram of the headroom expander 50 and A/D converters 32A, 32B shown in FIG. 1. The front microphone and rear microphone A/D converters 32A, 32B include a preamplifier 405, an analog-to-digital conversion block 404, and a digital-to-analog conversion block 406. The headroom expander 50 includes two similar circuits, each circuit including a multiplier 400, a delay 401, a threshold/gain control block 402, and a level detector 403. Also shown are the front and rear microphones 24, 26 and a directional processor 410.

Operationally, the headroom expander circuits 400–403 optimize the operating point of the analog-to-digital converters 404 by adjusting the gain of the preamplifiers 405 in a controlled fashion while adjusting the gain of the multipliers 400 in a correspondingly opposite fashion. Thus, the overall gain from the input to the A/D converters 32A, 32B through to the output of the multipliers 400 is substantially independent of the actual gain of the preamplifiers 405. The gain applied by the preamplifiers 405 is in the analog domain while the gain adjustment by the multipliers 400 is in the digital domain, thus resulting in a mixed signal compression expander system that increases the effective dynamic range of the analog-to-digital converters 404.

The analog signal generated by the front microphone 24 is coupled as an input to the preamplifier 405 which applies a variable gain that is controlled by a feedback signal from the threshold and gain control block 402. The amplified output from the preamplifier 405 is then converted to the digital domain by the analog-to-digital conversion block 404. The analog-to-digital conversion block 404 may, for example, be a Sigma-Delta modulator followed by decimation filters as described above with reference to FIGS. 1 and 2, or may be some other type of analog-to-digital converter.

The digital output from the analog-to-digital conversion block 404 is coupled as inputs to the multiplier 400 and the level detector 403. The level detector 403 determines the magnitude of the output of the analog-to-digital conversion block 404, and generates an energy level output signal. The level detector 403 operates similarly to the twin detector 54 described above with reference to FIG. 1.

The energy level output signal from the level detector 403 is coupled to the threshold and gain control block 402 which determines when the output of the analog-to-digital converter 404 is above a pre-defined level. If the output of the analog-to-digital converter 404 rises above the pre-defined level, then the threshold and gain control block 402 reduces the gain of the preamplifier 405 and proportionally increases the gain of the multiplier 400. The threshold and gain control block 402 controls the gain of the preamplifier 405 with a preamplifier control signal 412 that is converted to the analog domain by the digital-to-analog converter 406. With respect to the multiplier 400, the threshold and gain control block 402 adjusts the gain by generating an output gain control signal 414 which is delayed by the delay block 401 and is coupled as a second input to the multiplier 400. The delay introduced to the output gain control signal 414 by the delay block 401 is pre-selected to match the delay resulting from the process of analog to digital conversion (including any decimation) performed by the analog-to-digital conversion block 404. Exemplary gain adjustments that may be performed by the threshold and gain control block 402 are described below with reference to FIGS. 5*a*–5*c*.

Similarly, the signal from the rear microphone 26 is optimized by the rear microphone A/D converter 32B and the second headroom expander circuit 400–403. The outputs from the two multipliers 400 are then coupled as inputs to a directional processor 410. As described above with reference to FIG. 1, the directional processor 410 compares the two signals, and generates a directionally-sensitive response such that gain applied by the directional processor 410 has a maximum value for sounds coming from the front microphone 24 and a minimum value for sounds coming from the rear microphone 26. The directional processor 410 may, for example, be implemented as a delay sum beamformer, which is a configuration commonly understood by those skilled in the art. In addition, the directional processor 410 may also include a matching filter coupled in series with the delay sum beamformer that filters the signals from the front and rear microphone headroom expander circuits 400–403 such that the rear microphone frequency response is substantially the same as the front microphone frequency response.

Figure 5A:
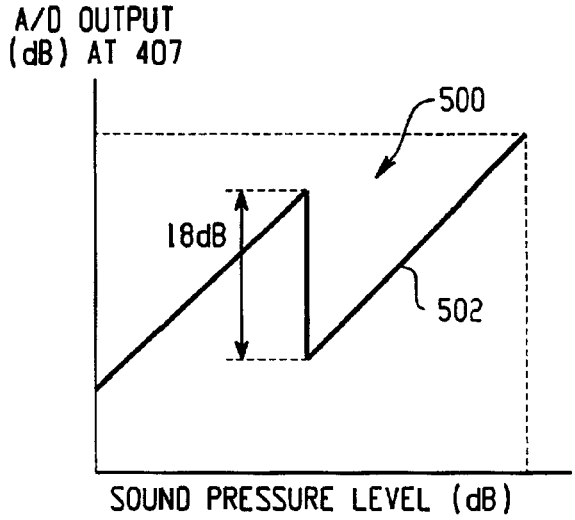
FIGS. 5*a*–5*c* are graphs illustrating exemplary gain adjustments that may be performed by the threshold and gain control block shown in FIG. 4.
Figure 5B:
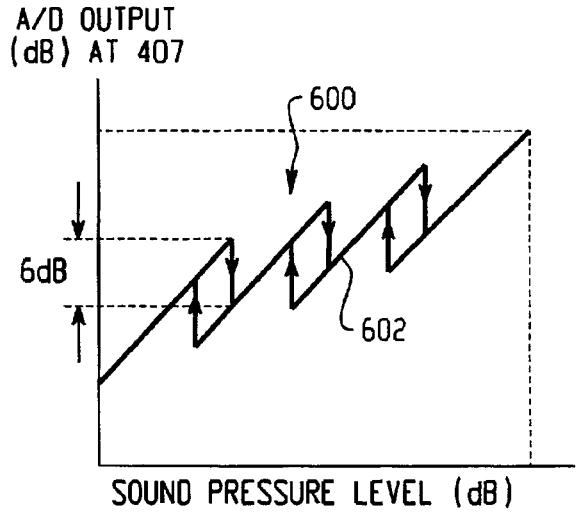
Figure 5C:
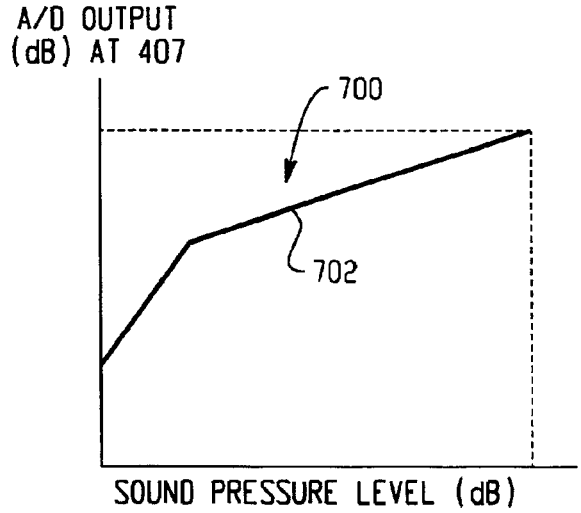

FIGS. 5*a*–5*c* are graphs 500, 600, 700 illustrating exemplary gain adjustments that may be performed by the threshold and gain control block 402 shown in FIG. 4. FIG. 5*a* illustrates a single-step gain 502, FIG. 5*b* illustrates a multi-step gain 602, and FIG. 5*c* illustrates a continuous gain 702. The vertical axis on each graph 500, 600, 700 represents the output of the analog-to-digital conversion block 404, illustrated as node 407 in FIG. 4. The horizontal axis on each graph 500, 600, 700 represents the sound pressure level detected by the front and rear microphones 24, 26.

The single-step gain 502 illustrated in FIG. 5*a* may be implemented by the threshold and gain control block 402 with only two gain levels for the preamplifier 405. This allows the digital-to-analog conversion block 406 to consist of a 1-bit process, and enables the multiplier 400 to be realized with a sign extended shift (requiring less area and power than a true multiplier). For example, left-shifting the digital-to-analog converter output 407 by 3 bits results in multiplication by 18 dB in the digital domain, and could be matched by designing the preamplifiers 405 such that their gains also differ by 18 dB.

The multi-step gain 602 illustrated in FIG. 5*b* implements an 18 dB gain change in three 6 dB steps. Similar to the single-step gain implementation 500 described above, this implementation 600 enables the multiplier 400 to be realized through simple bit shifting. In addition, this multi-step gain implementation 602 adds hysteresis to the threshold levels of the analog-to-digital converter output 407. In this manner, gain switching activity is reduced leading to fewer opportunities for audible artifacts.

The continuous gain 702 illustrated in FIG. 5*c* requires the threshold and gain control block 402 to continuously adjust the gain of the preamplifier 405. Thus, in order to implement this embodiment 700, the preamplifier 405 should have a continuously adjustable variable gain and the digital-to-analog converter 406 should have a higher resolution than necessary to implement the embodiments illustrated in FIGS. 5*a* and 5*b*. In addition, the multiplier 400 should be a full multiplier having resolution greater than the simple arithmetic shifting techniques previously discussed.

This written description uses examples to disclose the invention, including the best mode, and also to enable any person skilled in the art to make and use the invention. The patentable scope of the invention is defined by the claims, and may include other examples that occur to those skilled in the art.

We claim:

1. A digital hearing aid, comprising:

a front microphone that receives an acoustical intended signal and generates an analog intended signal;

a front microphone analog-to-digital converter coupled to the front microphone that converts the analog intended signal to a digital intended signal;

a rear microphone that receives an acoustical occlusion signal from the ear canal of a digital hearing aid user and generates an analog occlusion signal;

a rear microphone analog-to-digital converter coupled to the rear microphone that converts the analog occlusion signal to a digital occlusion signal;

a sound processor coupled to the front microphone analog-to-digital converter that selectively modifies the frequency response of the digital occlusion signal to match pre-selected signal characteristics and generates a processed intended signal;

an occlusion sub-system coupled to the processed intended signal and the digital occlusion signal that subtracts the digital occlusion signal from the processed intended signal and generates an occlusion sub-system output signal;

a digital-to-analog converter coupled to the occlusion sub-system that converts the occlusion sub-system output signal into an analog hearing aid output signal; and a speaker coupled to the digital-to-analog converter that converts the analog hearing aid output signal to an acoustical hearing aid output signal that is directed into the ear canal of the digital hearing aid user.

2. The digital hearing aid of claim 1, wherein the occlusion sub-system comprises:

a summation circuit having a positive input coupled to the processed intended signal and a negative input coupled to the digital occlusion signal that subtracts the digital occlusion signal from the processed intended signal and generates the occlusion sub-system output signal.

3. The digital hearing aid of claim 1, wherein the occlusion sub-system comprises:

a high frequency equalizer coupled to processed intended signal that applies a transfer function to the processed intended signal.

4. The digital hearing aid of claim 3, wherein the occlusion sub-system further comprises:

a loop filter coupled to the occlusion sub-system output that applies a transfer function to the occlusion sub-system output signal, wherein the transfer function applied by the high frequency equalizer is a function of the transfer function applied by the loop filter.

5. The digital hearing aid of claim 1, wherein the front microphone analog-to digital converter samples the analog intended signal at a first sample rate and the rear microphone analog-to-digital converter samples the analog occlusion signal at a second sample rate, and wherein the occlusion sub-system comprises:

an interpolator coupled to the processed intended signal that increases the first sample rate of the processed intended signal to match the second sample rate of the digital occlusion signal.

6. The digital hearing aid of claim 1, wherein the occlusion sub-system comprises:

a microphone equalizing filter coupled to the digital occlusion signal that applies a transfer function to the digital occlusion signal, wherein the transfer function is a function of the magnitude response of the rear microphone and the rear microphone analog-to-digital converter.

7. The digital hearing aid of claim 1, wherein the occlusion sub-system comprises:

a high frequency equalizer coupled to the processed intended signal that applies a transfer function to the processed intended signal and generates a high frequency equalizer output signal;

a microphone equalizing filter coupled to the digital occlusion signal that applies a transfer function to the digital occlusion signal and generates a microphone equalizing filter output signal, wherein the transfer function is a function of the magnitude response of the rear microphone and the rear microphone analog-to-digital converter;

a summation circuit having a positive input coupled to the high frequency equalizer output signal and a negative input coupled to the microphone equalizing filter output signal that subtracts the microphone equalizing output signal from the high frequency equalizer output signal to generate a summation circuit output signal;

a loop filter coupled to the summation circuit output signal that applies a transfer function to the summation circuit output signal to generate a loop filter output signal, wherein the transfer function applied by the high frequency equalizer is a function of the transfer function applied by the loop filter; and a speaker equalizing filter coupled to the loop filter output signal that flattens the frequency response of speaker and generates the occlusion sub-system output signal.

8. The digital hearing aid of claim 7, wherein the front microphone analog-to digital converter samples the analog intended signal at a first sample rate and the rear microphone analog-to-digital converter samples the analog occlusion signal at a second sample rate, and wherein the occlusion sub-system further comprises:

an interpolator coupled to the high frequency equalizer output signal that increases the first sample rate of the high frequency equalizer output signal to match the second sample rate of the digital occlusion signal.

9. The digital hearing aid of claim 7, wherein the occlusion sub-system further comprises:

an interpolator and peak clipper coupled to the occlusion sub-system output signal that increases the frequency of the occlusion sub-system output signal and that limits the amplitude of the occlusion sub-system output signal to a pre-selected level in order to minimize the effects of aliasing.

10. A digital hearing aid, comprising:

a front microphone that receives a front acoustical signal and generates a front microphone analog signal;

a front microphone analog-to-digital converter coupled to the front microphone that converts the front microphone analog signal into a front microphone digital signal, wherein the front microphone analog-to-digital converter includes a front microphone preamplifier that applies a gain to the front microphone analog signal prior to conversion into the digital domain;

a front microphone headroom expander coupled to the front microphone analog-to-digital converter that applies a gain to the front microphone digital signal to generate a front microphone headroom expander output signal, wherein the front microphone headroom expander is configured to detect the energy level of the front microphone digital signal and vary the gain applied by the front microphone preamplifier as a function of the detected energy level;

a sound processor coupled to the front microphone headroom expander output signal that selectively modifies the frequency response of the front microphone headroom expander output signal to match pre-selected signal characteristics and generates a processed signal;

a digital-to-analog converter coupled to the sound processor that converts the processed output into an analog hearing aid output signal; and a speaker coupled to the digital-to-analog converter that converts the analog hearing aid output signal into an acoustical hearing aid output signal that is directed into the ear canal of the digital hearing aid user.

11. The digital hearing aid of claim 10, further comprising:

a rear microphone that receives a rear acoustical signal and generates a rear microphone analog signal;

a rear microphone analog-to-digital converter coupled to the rear microphone that converts the rear microphone analog signal to a rear microphone digital signal, wherein the rear microphone analog-to-digital converter includes a rear microphone preamplifier that applies a gain to the rear microphone analog signal prior to conversion to the digital domain; and a rear microphone headroom expander coupled to the rear microphone analog-to-digital converter that applies a gain to the rear microphone digital signal to generate a rear microphone headroom expander output signal, wherein the rear microphone headroom expander is configured to detect the energy level of the rear microphone digital signal and vary the gain applied by the rear microphone preamplifier as a function of the detected energy level;

wherein the sound processor is also coupled to the rear microphone headroom expander output signal and selectively modifies the frequency response of the rear microphone headroom expander output signal to match pre-selected signal characteristics and generate the processed signal.

12. The digital hearing aid of claim 11, further comprising:

a directional processor coupled to the front microphone headroom expander output signal and the rear microphone headroom expander output signal that reduces the gain of the rear microphone headroom expander output signal in relation to the gain of the front microphone headroom expander output signal.

13. The digital hearing aid of claim 12, wherein the directional processor comprises a delay sum beamformer.

14. The digital hearing aid of claim 13, wherein the directional processor further comprises a matching filter coupled in series with the delay sum beamformer that filters the front and rear microphone headroom expander output signals such that the frequency response of the front microphone is substantially equal to the frequency response of the rear microphone.

15. The digital hearing aid of claim 10, wherein the front microphone headroom expander varies the gain applied to the front microphone digital signal is proportion to the gain applied by the front microphone preamplifier.

* * * * *